US010619107B2

(12) United States Patent
Kraus et al.

(10) Patent No.: US 10,619,107 B2
(45) Date of Patent: Apr. 14, 2020

(54) HEATER COIL

(71) Applicant: Honeywell International Inc., Morris Plains, NJ (US)

(72) Inventors: Kurt E. Kraus, Tulsa, OK (US); Matthew A. Martin, Tulsa, OK (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 16/012,431

(22) Filed: Jun. 19, 2018

(65) Prior Publication Data

US 2018/0371330 A1 Dec. 27, 2018

Related U.S. Application Data

(60) Provisional application No. 62/523,594, filed on Jun. 22, 2017.

(51) Int. Cl.
*C10G 9/20* (2006.01)
*F28D 7/06* (2006.01)
(Continued)

(52) U.S. Cl.
CPC ..... *C10G 9/20* (2013.01); *F28D 7/06* (2013.01); *F28F 1/40* (2013.01); *F28F 9/013* (2013.01);
(Continued)

(58) Field of Classification Search
CPC ... C10G 9/00; C10G 9/14; C10G 9/18; C10G 9/20; F28D 7/00; F28D 7/06; F28D 21/00;
(Continued)

(56) References Cited

U.S. PATENT DOCUMENTS 4,454,839 A * 6/1984 Gater ..... B01J 8/062 122/18.4
5,109,277 A 4/1992 James
(Continued)

FOREIGN PATENT DOCUMENTS

CN 1069960 C 8/2001
CN 1308224 A 8/2001
(Continued)

OTHER PUBLICATIONS

Lohr et al.,"Three dimensional temperature estimation of a fire plume . . . ," Proceedings of SPIE—The International Society for Optical Engineering (2014), vol. 9071, 16 pages.
(Continued)

*Primary Examiner* — Natasha E Young

(57) ABSTRACT

A heater coil for heating a feedstock comprises an inlet manifold and an outlet manifold having longitudinal extensions that are parallel. A plurality of process tubes are suspended from and in fluid communication with the inlet manifold and the outlet manifold. Each process tube comprises an inlet leg coupled to the inlet manifold, an outlet leg coupled to the outlet manifold, and a U-shaped portion disposed between the inlet leg and the outlet leg for passage of the feedstock therethrough. The inlet manifold and the outlet manifold are elevated with respect to the plurality of process tubes. Each of the plurality of process tubes is aligned such that a width of the plurality of process tubes extends along a direction that is not perpendicular to the longitudinal extensions of the inlet and outlet manifolds.

18 Claims, 5 Drawing Sheets

(51) Int. Cl.

| | |
|---|---|
| ***F28F 1/40*** | (2006.01) |
| ***F28F 9/013*** | (2006.01) |
| *F28D 21/00* | (2006.01) |

(52) U.S. Cl.
CPC ..... *C10G 2300/405* (2013.01); *F28D 2021/0059* (2013.01)

(58) Field of Classification Search
CPC ..... F28D 2021/0019; F28D 2021/0059; F28F 1/00; F28F 1/10; F28F 1/40; F28F 9/00; F28F 9/007; F28F 9/013
See application file for complete search history.

(56) References Cited

U.S. PATENT DOCUMENTS

| | | | | |
|---|---|---|---|---|
| 6,528,027 | B1 * | 3/2003 | Brewer | C10G 9/20 196/110 |
| 6,630,670 | B2 | 10/2003 | Salisbury et al. | |
| 7,358,860 | B2 | 4/2008 | Germouni et al. | |
| 7,440,620 | B1 | 10/2008 | Aartsen | |
| 8,018,590 | B2 | 9/2011 | Davis, Jr. et al. | |
| 8,138,927 | B2 | 3/2012 | Diepenbroek et al. | |
| 8,428,391 | B2 | 4/2013 | Park | |
| 8,547,331 | B2 | 10/2013 | Warnke et al. | |
| 2011/0085030 | A1 | 4/2011 | Poe et al. | |
| 2012/0174590 | A1 | 7/2012 | Krull et al. | |
| 2012/0257018 | A1 | 10/2012 | Shigemura et al. | |
| 2013/0235163 | A1 | 9/2013 | Joo | |

FOREIGN PATENT DOCUMENTS

| | | | |
|---|---|---|---|
| CN | 1352369 | A | 6/2002 |
| CN | 102881041 | A | 1/2013 |
| CN | 104299268 | A | 1/2015 |
| DE | 102005036146 | A1 | 2/2007 |
| GB | 2361371 | A | 10/2001 |
| JP | 2000259230 | A | 9/2000 |
| JP | 2009014359 | A | 1/2009 |
| WO | 1986007455 | A1 | 12/1986 |
| WO | 2011004396 | A1 | 1/2011 |
| WO | 2011067003 | A1 | 6/2011 |

OTHER PUBLICATIONS

Verstockt et al., "FireCube: A multi-view localization framework for 3D fire analysis," Fire Safety Journal (2011), 46(5), 262-275.
Pizzuti et al.,"Influence of refraction and divergence of light on tomography of axisymmetric laminar diffusion flames," Fuel (2013), vol. 106, 372-379.
Wang et al., "Effects of particle concentration and optical thickness on flame temperature . . . ," Chinese Journal of Scientific Instrument (2007), 28(11), 2003-2007.
Li et al., "Volumetric imaging of turbulent reactive flows at kHz based on computed tomography," Optics Express (2014), 22(4), 4768-4778.
"ThermoPro™ TP8" AMETEK Company, Product brochure—thermal imaging camera, Copyright © 2007, Land Instruments International.
Ishino et al., "Three Dimensional Computerized Tomographic Reconstruction of Instantaneous Distribution . . . " JSME International Journal, Series B (2005), 48(1), 34-40.
Lu et al., "Advance Monitoring and Characterisation of Combustion Flames," 20th Annual Meeting of the Combustion and Advance Power Generation Divisions, Apr. 22, 2009, 1-25.
Hossain et al., "Three-dimensional reconstruction of flame temperature and emissivity distribution . . . ," Measurement Science and Technology (2013), 24(7).
Yong, Yan, "Advanced Sensors and Monitoring Techniques for the optimization of Coal and Biomass Fired Power Plants," University of Zagreb Lecture, May 2012, 1-23.
"FLIR GF309—Infrared camera for furnace and electrical inspections," Product Brochure and Spec., FLIR Systems, Inc. <http://www.flircom>, 1999, obtained Apr. 9, 2014.

* cited by examiner

SECTION E-E

SECTION A-A

HEATER COIL

CROSS-REFERENCE TO RELATED APPLICATION

This application claims priority from Provisional Application No. 62/523,594 filed Jun. 22, 2017, the contents of which cited application are hereby incorporated by reference in its entirety.

FIELD OF THE INVENTION

This invention relates generally to heaters for hydrocarbon processes.

BACKGROUND OF THE INVENTION

Heaters such as process heaters and furnaces are commonly used for heating a feedstock in hydrocarbon processes such as reforming, cracking, catalyst regeneration, dehydrogenation, and others. Example heaters include a firebox having firing walls extending along the length of the firebox, and end walls disposed at ends of the firebox. A heater coil includes a plurality of process tubes that are disposed within the firebox. The process tubes are arranged along a line parallel to the firing walls in the firebox chamber. A feedstock, e.g., a hydrocarbon feedstock, passes through the inlet manifold, through the process tubes, and through the outlet manifold. The process tubes are exposed to radiant heat generated from burners. The burners typically are arranged along the firing walls.

In operation, the feedstock is introduced to the process tubes through the inlet manifold. The feedstock is heated as it flows through the process tubes to provide a product. In a cracking process, for example, the heated feedstock is thermally cracked to provide a cracked gas product, which exits through the outlet manifold.

To improve yield and selectivity, among other advantages, it is useful to form the process tubes in a U-shape. The U-shaped process tubes conventionally have a small diameter, and typically are suspended within the heater. However, with conventional heater coils, burners need to supply heat to both the outside and the inside of the process tubes for uniform heating. The performance of such burners can be unpredictable, and can result in excessive nitrogen oxide (NOx) emissions.

Therefore, there remains a need for effective and efficient apparatuses and processes for heating a feedstock.

SUMMARY OF THE INVENTION

The present invention is directed to providing apparatuses for heating a feedstock.

Accordingly, one aspect of the present invention provides a heater coil for heating a feedstock. The heater coil comprises an inlet manifold having a longitudinal extension, and an outlet manifold having a longitudinal extension that is parallel to the longitudinal extension of the inlet manifold. A plurality of process tubes are suspended from and in fluid communication with the inlet manifold and the outlet manifold. Each of the process tubes comprises an inlet leg coupled to the inlet manifold, an outlet leg coupled to the outlet manifold, and a U-shaped portion disposed between the inlet leg and said outlet leg for passage of the feedstock therethrough. The inlet manifold and the outlet manifold are elevated with respect to the plurality of process tubes. Each of the plurality of process tubes is aligned such that a width of each of the plurality of process tubes extends along a direction that is not perpendicular to the longitudinal extensions of the inlet and the outlet manifolds.

Another aspect of the present invention provides a heater for heating a feedstock. The heater comprises a firebox chamber having opposed first and second firing walls and opposed first and second end walls, an inlet manifold having a longitudinal extension, and an outlet manifold having a longitudinal extension that is parallel to the longitudinal extension of the inlet manifold. A plurality of process tubes are disposed between the first and second firing walls, and are suspended from and in fluid communication with the inlet manifold and the outlet manifold. Each of the process tubes comprises an inlet leg coupled to the inlet manifold, an outlet leg coupled to the outlet manifold, and a U-shaped portion disposed between the inlet leg and the outlet leg for passage of the feedstock therethrough. The inlet manifold and the outlet manifold are elevated with respect to the plurality of process tubes. Each of the plurality of process tubes are aligned such that a width of each of the plurality of process tubes extends along a direction that is not perpendicular to the longitudinal extensions of the inlet and the outlet manifolds.

Another aspect of the invention provides a heater for heating a feedstock. The heater comprises a firebox chamber having opposed first and second firing walls and opposed first and second end walls, an inlet manifold having a longitudinal extension, and an outlet manifold coplanar with the inlet manifold and having a longitudinal extension that is parallel to the longitudinal extension of the inlet manifold. A plurality of process tubes are uniformly disposed between the first and second firing walls, and are suspended from and in fluid communication with the inlet manifold and said outlet manifold. Each of the process tubes comprises an inlet leg coupled to the inlet manifold, an outlet leg coupled to the outlet manifold, and a U-shaped portion disposed between the inlet leg and the outlet leg for passage of the feedstock therethrough. A plurality of burners are disposed along the first and second firing walls. The inlet manifold and the outlet manifold are elevated with respect to the plurality of process tubes. Each of the plurality of process tubes are uniformly aligned such that a width of each of the plurality of process tubes extends between an angle with respect to the longitudinal extensions of the inlet and the outlet manifolds and with respect to the first and second firing walls.

Additional objects, embodiments, and details are set forth in the following detailed description.

DETAILED DESCRIPTION OF THE DRAWINGS

DETAILED DESCRIPTION

An example heater provides more uniform heating of process tubes by more uniformly heating a firing wall that radiates heat to the process tubes, and by more uniformly exposing the process tubes to heat that is radiated directly from a burner flame. Burners, heater coils of process tubes, and firebox chambers can be sized and positioned to expose uniformly arranged process tubes to uniformly arranged burners and the firing walls.

At the ends of the firing walls, particularly at the end walls and corners, fewer process tubes are exposed, and therefore less heating is required. This permits a reduction of a required firing rate of the burners near the end walls, which in turn makes the flame and heating behavior near end walls and corners of heaters more uniformly match that of the other burners on a firing wall. Reduction of the process tubes near the end walls allows for overall uniform heating of the process tubes. An example heater provides more consistent, uniform, predictable, and tunable radiant heating of process tubes in heater coils.

Example heaters can be configured to make burner, heater coil, and overall heater configurations more consistent, modularized, or packaged. Example heaters can be readily and directly scalable to allow application to processes requiring varying heat demand. Example heaters can further reduce or eliminate existing non-uniformities found in heaters of similar shape and design, particularly where uniformly sized burners can exhibit unacceptably long, uncontrollable flames near corners or end walls. Example heaters can also provide reduced NOx emissions compared to conventional process heaters or furnaces.

Figure 2:
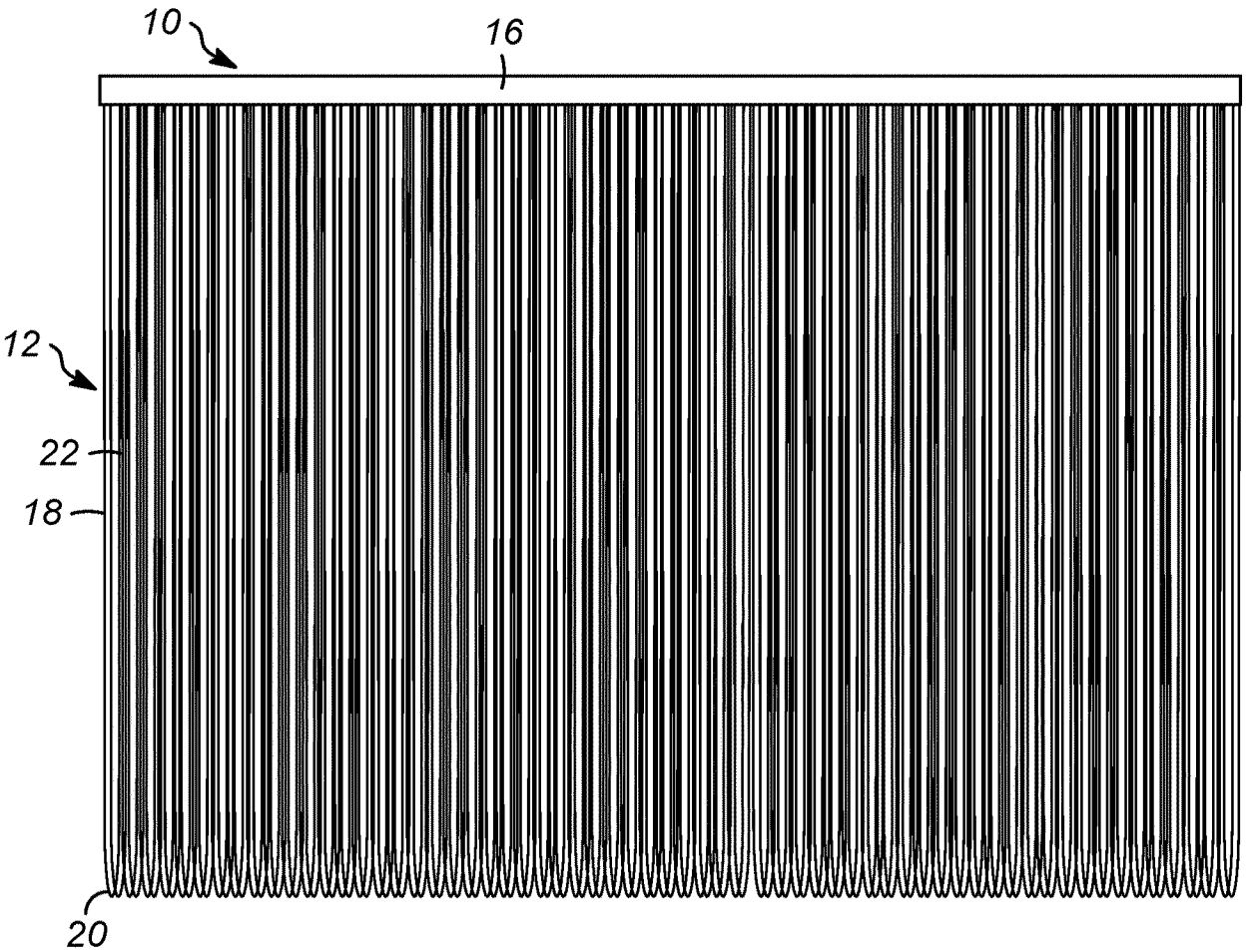
(Prior Art) FIG. 2
FIG. 2 is a side elevation view of the heater coil of FIG. 1.
Figure 1:
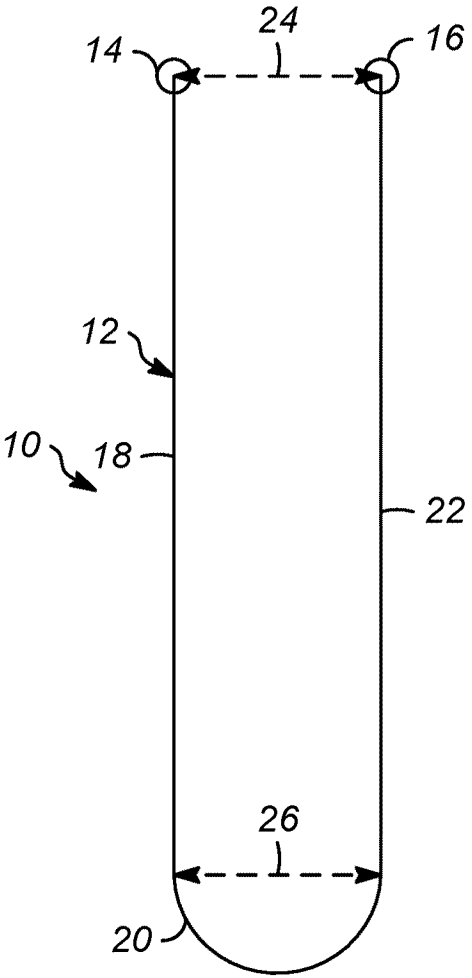
(Prior Art) FIG. 1
FIG. 1 is an end elevation view of a prior art heater coil for a heater.

Referring now to the drawings, FIGS. 1-2 show a heater coil 10 for receiving a feedstock in a conventional heater, such as a process heater or furnace. The heater coil 10 includes a plurality of U-shaped process tubes 12 that are suspended from, coupled to, and in fluid communication with an elevated inlet manifold 14 for receiving the feedstock and an elevated outlet manifold 16 for outputting a heated product. The inlet manifold 14 and the outlet manifold 16 have longitudinal extensions that are parallel to one another, which in FIG. 1 is along a direction normal to the plane of the figure, and in FIG. 2 (only the outlet manifold 16 is visible in FIG. 2) is along a direction parallel to the plane of the figure. As shown in FIG. 1, the inlet manifold 14 and the outlet manifold 16 are preferably coplanar, e.g., such that the inlet manifold and the outlet manifold longitudinally extend along the same vertical plane.

The process tubes 12 each include a substantially straight inlet leg 18 merging to a U-shaped section 20 and then to a substantially straight outlet leg 22. The inlet leg 18, the U-shaped section 20, and the outlet leg 22 are in fluid communication with one another so that feedstock enters through the inlet manifold 14, and passes, in turn, through the inlet leg 18, the U-shaped section 20, the outlet leg 22, and then through the outlet manifold 16 as heated feedstock.

In the heater coil 10, each process tube 12 is uniformly aligned perpendicularly with respect to firing walls of a heater, and perpendicularly to the longitudinal extension of the inlet and outlet manifolds 14, 16 defining a plurality of planes equal to the number of process tubes. "Uniformly aligned" refers to the alignment of the process tubes 12 being within 0.1 to 5 degrees of one another. As shown in FIG. 1, a width of the process tube 12, defined either by the direction between the inlet leg 18 and the outlet leg 22 or the direction of a diameter 26 of the U-shaped section 20 between opposing ends of the U-shaped section, extends perpendicularly with respect to the longitudinal extension of the inlet and outlet manifolds 14, 16. In this arrangement the inlet and outlet manifolds 14, 16 are maximally separated; that is, separated by the full width of the process tube 12. For example, a distance 24 separating the inlet and outlet manifolds 14, 16 equals a width of the process tube 12 as defined by the diameter 26 defined by the U-shaped portion 20.

As shown in FIG. 2, the outwardly facing surfaces of the process tubes 12 can be directly exposed to heat radiated from the opposing (side) firing walls. However, the inwardly facing surfaces of the process tubes 12 are not directly exposed to such radiated heat, so that the process tubes are not uniformly exposed to the heat, even with uniformly arranged and sized burners in a heater. This reduces the uniformity of radiant heating of the process tubes 12. One way of accounting for such non-uniform heating is to increase heat from burners near the end walls. However, this solution introduces unpredictable flames, can result in unacceptably long and even uncontrollable flames near corners or end walls, and increases NOx emissions.

Figure 4:
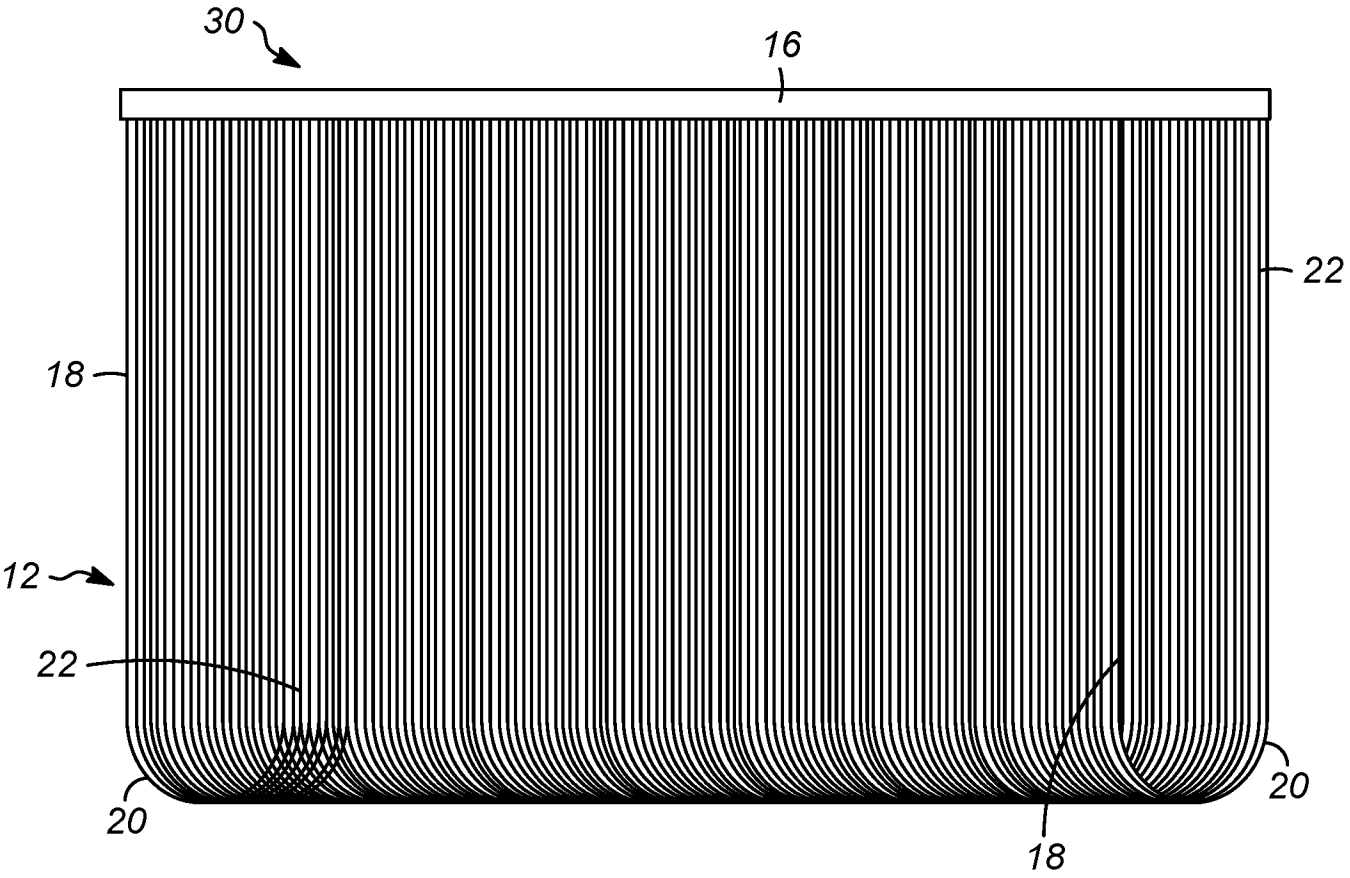
FIG. 4 is a side elevation view of the heater coil of FIG. 4.
Figure 3:
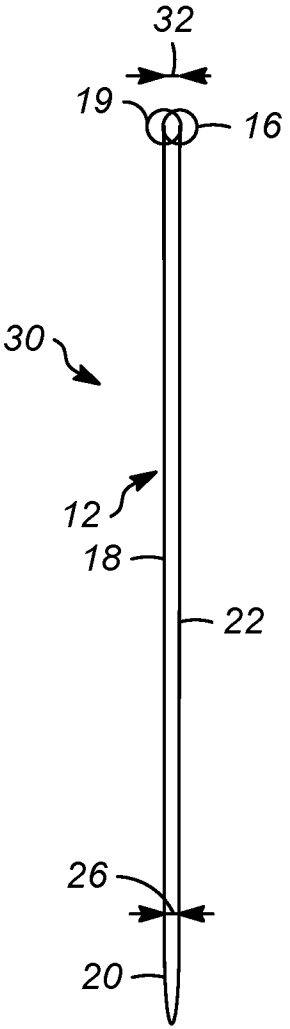
FIG. 3 is an end elevation view of an example heater coil for a heater.
Figure 5:
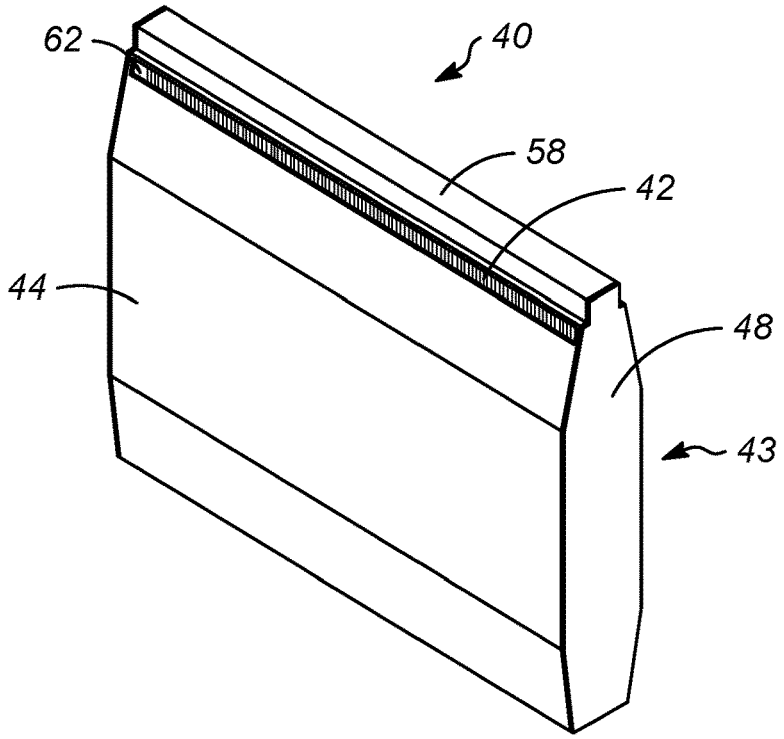
FIG. 5 is a perspective view of a heater.
Figure 6:
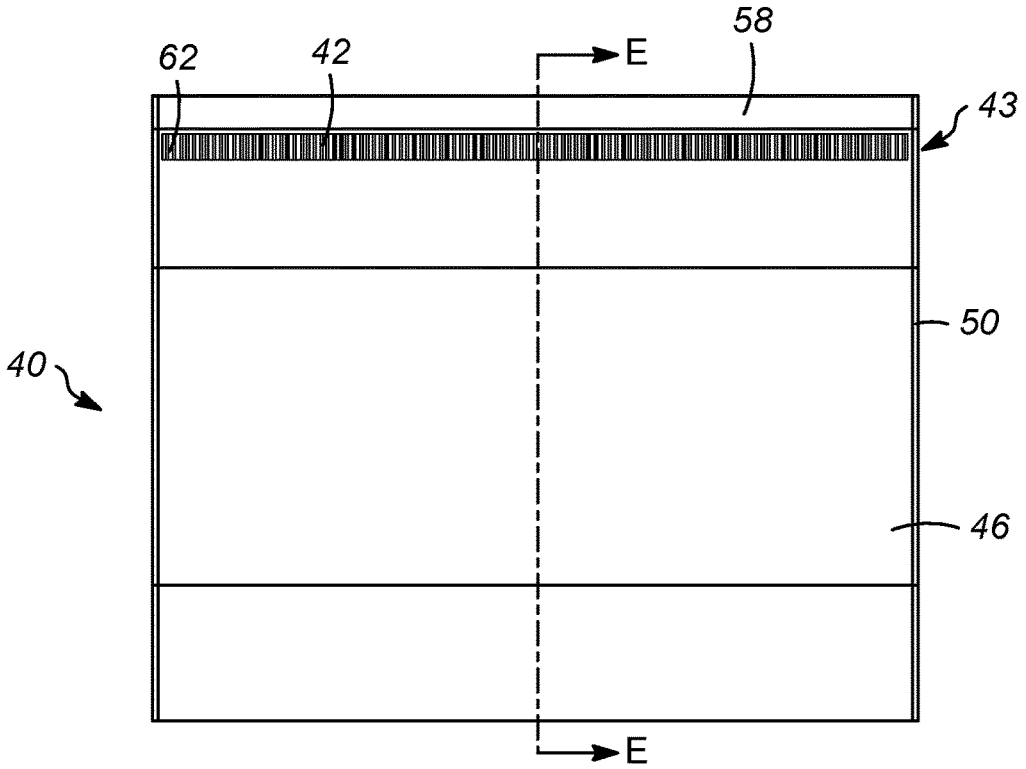
FIG. 6 is a side elevation view of the heater of FIG. 5.

FIGS. 3-4 show a heater coil 30 for receiving a feedstock an example heater, such as a process heater or furnace, where like reference characters refer to like parts. The heater coil 30 includes a plurality of uniformly disposed (e.g., uniformly spaced) process tubes 12 that are coupled to the inlet manifold 14 and the outlet manifold 16. Preferably, the inlet manifold 14 and the outlet manifold 16 are coplanar in that they extend longitudinally along the same vertical plane. However, in other heater coils, the inlet and outlet manifolds 14, 16 may be offset (e.g., in different vertical planes) with respect to one another.

In the heater coil 30, each of the process tubes 12 is aligned, preferably uniformly, along a direction that is not perpendicular to the longitudinal extensions of the inlet manifold 14 and the outlet manifold 16. Preferably, the alignment of the process tubes 12 is not completely parallel, for instance if the inlet manifold 14 and the outlet manifolds 16 are coplanar. However, it is preferred that the process tubes 12 are as close to parallel to the inlet manifold 14 and outlet manifold 16 as mechanically and physically possible.

For example, while the process tubes 12 in the heater coil 10 have a width between the inlet leg 18 and the outlet leg 22 that extends approximately 90 degrees with respect to the longitudinal extensions of the inlet manifold 14 and the outlet manifold 16, each of the process tubes 12 in the heater coil 30 have a width (e.g., along the direction shown in FIG. 3 by the diameter 26 of the U-shaped portion 20) that extends between 60 and 85 degrees, and preferably between 70 and 80 degrees, with respect to the longitudinal extensions of the inlet manifold and the outlet manifold. This similarly aligns the process tubes with respect to the firing walls of a heater. In such arrangements, an array of the process tubes 12 may be thought of as being collapsed, as viewed in FIG. 4.

By aligning the process tubes 12 in a non-perpendicular direction with respect to the inlet and outlet manifolds 14, 16 of the heater coil 30, the inlet and outlet manifolds are disposed much more closely to one another, i.e., they are separated by a distance 32 much less than the width (e.g., diameter 26) of the process tube 12. Particularly, an example distance separating the inlet and outlet manifolds 14, 16 is less than 20% of the width of the process tubes 12, and preferably less than 10%. By contrast, in the heater coil 10, inlet and outlet manifolds 14, 16 are separated by a distance equal to the diameter of the U-shaped portion 20 in the process tubes 12.

FIGS. 5-9 show an example heater 40, such as a process heater or furnace, where like reference characters refer to like parts. The heater 40 has a heater coil 42 with process tubes 12 in a collapsed arrangement, so that they are aligned along a direction that is not perpendicular, and in this example is nearly parallel, with respect to the longitudinal extension of the inlet and outlet manifolds 14, 16.

Figure 7:
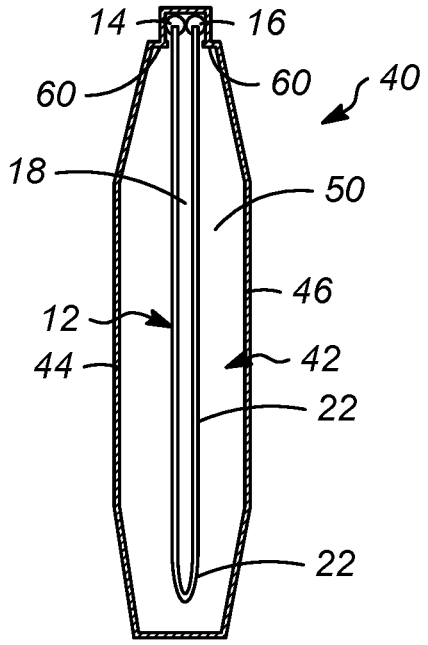
FIG. 7 is a sectional view of the heater of FIG. 5, taken along E-E of FIG. 6 and in the direction indicated.
Figure 8:
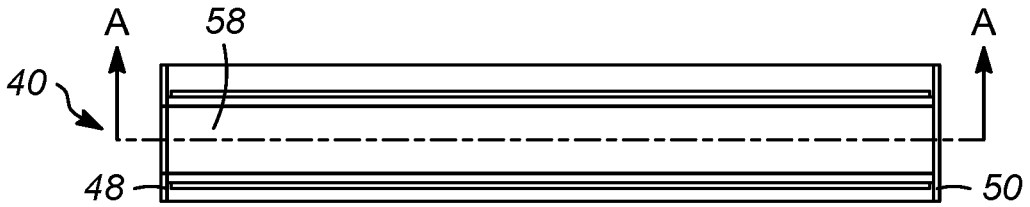
FIG. 8 is a top plan view of the heater of FIG. 5.
Figure 9:
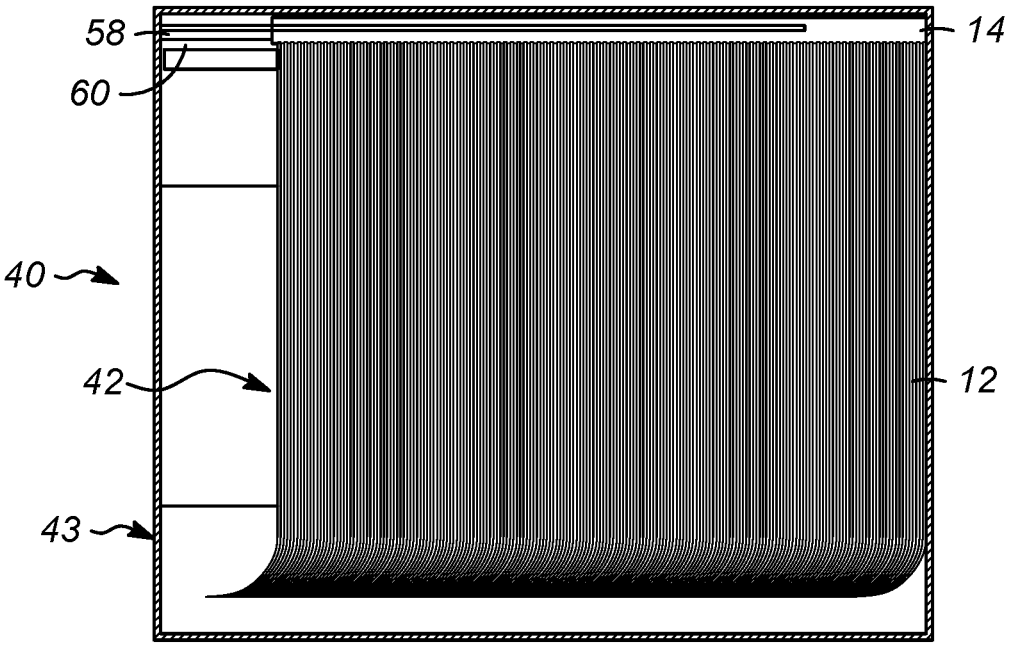
FIG. 9 is a sectional view of the heater of FIG. 5, taken along line A-A of FIG. 8 and in the direction indicated.

The heater 40 further includes a firebox chamber 43 having first and second opposing firing (side) walls 44, 46, e.g., left and right side walls, and first and second opposing end walls 48, 50. The firing walls 44, 46 each include a substantially vertical central portion 52, and upper and lower tapered portions 54, 56. A compartment 58 disposed over and between the firing walls 44, 46 is preferably dimensioned to accommodate the elevated inlet and outlet manifolds 14, 16 which in an example arrangement longitudinally extend parallel to one another, are coplanar, and are adjacent to one another. Preferably, as shown in FIG. 7, the inlet and outlet manifolds 14, 16 are directly adjacent to one another and abut one another. Thus, in this arrangement, the inlet and outlet manifolds 14, 16 are separated from one another by a distance substantially equal to their respective diameters.

The compartment 58 includes lower flanges 60 extending below a portion of each of the inlet and outlet manifolds 14, 16 that provide shelves to keep the inlet and outlet manifolds in an elevated position and at an even height with one another (e.g., such that the longitudinal extensions of the inlet and outlet manifolds are along the same vertical plane). Preferably, the heater coil 42 includes a single inlet manifold 14 and a single outlet manifold 16, to which all of the process tubes 12 are coupled. The firebox chamber 43 preferably is substantially enclosed except for openings 62, such as windows, provided on each of the first and second firing walls 44, 46.

Each of the process tubes 12 is suspended from the inlet and outlet manifolds 14, 16 as shown by example in FIG. 7. Ends of the process tubes 12 are coupled to the inlet and outlet manifolds 14, 16. As best viewed in FIGS. 7 and 9, the process tubes 12 are arranged at a uniform non-perpendicular and non-parallel angle, with respect to the (parallel) longitudinal extensions of the inlet and outlet manifolds 14, 16. In this way, both sides of each process tube 12 are exposed to either the first and second firing walls 44, 46. Burners (not shown) are preferably uniformly disposed (that is, disposed at uniform intervals, or uniformly spaced) along the first and second firing walls 44, 46. The burners may be wall or floor fired burners.

The first and second firing walls 44, 46 the first and second end walls 48, 50 and the compartment 58 of the firebox chamber 43 may be made of a heat-resistant material. The first and second firing walls 44, 46 and the compartment 58 can be, but need not be, formed as a unitary piece. Alternatively, any of the first and second firing walls 44, 46, the first and second end walls 48, 50, or the compartment 58 may be formed separately and assembled to provide the firebox chamber 43.

The process tube 18 and the inlet and outlet manifolds 14, 16 can be made of heat-resistant material. The diameter 26 of the U-shaped section portion 20 in the process tubes 12 can vary as needed. Providing a larger diameter bend in the U-shaped portion 20 can lower the pressure drop on a process gas. The lengths of the inlet leg 18 and the outlet leg 22 can also vary as needed. The number of process tubes 18 can vary as necessary. This number of process tubes 18 may be, for example, one-half the number of process tubes per unit length that would be provided if the process tubes were instead aligned perpendicularly as in the coil 10 in FIGS. 1-2.

The distance between the inlet manifold 14 and the outlet manifold 16 can be configured or adjusted as mechanically or geometrically needed or desired. Preferably, the inlet and outlet manifolds 14, 16 are positioned as closely together as mechanically and physically possible, such as in the heater coil 42. In this way, the plurality of process tubes 12 are aligned along and approximate a single plane.

Other variables that can be selected or adjusted for the heater 40 include the number of the process tubes 12, the spacing between the process tubes, the distance between the process tubes and the firing walls 44, 46 and the height of the firebox chamber 43. Selecting such variables in turn can determine a height, width, and length of the heater 40.

A linear configuration for the heater 40 can be directly scaled for different applications by lengthening or shortening the heater without substantially altering the burner design, linear design of the heater coil 30, 42 or the geometric relationship between the burner, firing walls 44, 46 and the adjacent process tubes 12. For example, for a particular configuration and arrangement, e.g., length of the process tubes 12, diameter of the U-shaped portion 20, distance between the inlet and outlet manifolds 14, 16, spacing between the process tubes, distance between the process tubes and the firing walls 44, 46, and the height of the firebox chamber 43, the heater 40 can be linearly scaled by increasing or decreasing the number of process tubes 12, and adding or subtracting uniformly arranged burners as needed along the firing walls 44, 46. This provides a modular configuration for the heater 40, making it easily configurable and suitable for various uses and environments.

A heat flux profile from one or more of the burners (not shown) can also be varied, including but not limited to burner heat release, burner to burner spacing, burner width (throat and tile) versus thickness from the firing wall 44, 46, how hard and where flames hit the firing wall, flame length, and flame intensity versus elevation above the burner. With such variables, burners, heater coils 30, 42 and the overall heater 40 can be configured based on a particular limit in peak tube temperature or radiant flux rate. Variations in absorbed duty required for various applications can be accommodated by making the heater 40 or heater coil 30, 42 longer or shorter, and by adding or deleting burners along the additional or reduced length of the heater, as provided above. For particular combinations of burner, heater 40, and heater coil 30, 42 geometries, a performance response spectrum can be provided for emissions, including NOx, fuel and air capacity, stability, turndown, etc. This can provide more predictable performance in heating applications, such as process heating applications.

In an example heating process using the heater 40, the feedstock, such as a hydrocarbon feedstock, is preheated to a predetermined temperature, and delivered to the inlet manifold 14, for instance via a supply line (not shown), by creating a pressure drop. From the inlet manifold 14, the feedstock flows to the inlet leg 18 of one of the process tubes 12, and then through the U-shaped section 20. The burners (not shown) are ignited, and heat from the burners radiates to the process tubes 12 via the firing walls 44, 46, heating the process tubes by radiant heating. Both sides of the process tubes 12 are heated by the burners, such as providing a double-fired heater. During the flow through the process tubes 12, the feedstock is heated to a desired temperature, for instance to crack the feedstock. The heated feedstock exits through the outlet manifold 16, for instance to further downstream processing.

Example collapsed arrangements of the process tubes 12 such as in coils 30, 42 expose substantially half the number of tubes per unit length to the firing walls 44, 46 and the burners near the end walls 48, 50 of the firebox chamber 43, as compared to a conventional process tube arrangement such as for the heater coil 10. However, the (collapsed) process tubes 12 are exposed to radiant heat from both sides (e.g., left and right sides) when disposed between the opposed firing walls 44, 46. The process tubes 12 are essentially double-fired when burners, e.g., floor-fired or wall-fired burners, are provided on both sides of the process tubes within the firebox chamber 43.

In an example method, the firing rate of the burners near the corners of the firebox chamber 43 are reduced relative to the rate of other burners to make the flame and heating behavior near the end walls 48, 50 and corners more uniformly match the other burners on the firing walls 44, 46. Reduction of the process tubes 12 near the end walls 48, 50 allows for more uniform heating of the process tubes 12 overall. The burners near the end walls 48, 50 in an example heater 40 can be reduced in capacity significantly.

Floor fired and wall fired burners produce flames that are long in the corners, which results in undesirable end wall effects. Reducing the firing of end wall burners can reduce these effects. However, for conventional heater coils such as heater coil 10, this leads to reduced heating. By providing a non-perpendicular arrangement of the process tubes 12 such as in the heater coil 30, 42, one can reduce the firing of corner burners to maintain more uniform heater coil heating, and mitigate end wall or corner effects. Reducing the capacity of such burners in turn improves burner flame quality as well as the ability to reliably predict the flame quality. It is thus possible to minimize NOx emissions in a more predictable manner.

It should be appreciated and understood by those of ordinary skill in the art that various other components such as valves, pumps, filters, coolers, etc. were not shown in the drawings as it is believed that the specifics of same are well within the knowledge of those of ordinary skill in the art and a description of same is not necessary for practicing or understating the embodiments of the present invention.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

SPECIFIC EMBODIMENTS

While the following is described in conjunction with specific embodiments, it will be understood that this description is intended to illustrate and not limit the scope of the preceding description and the appended claims.

A first embodiment of the invention is a heater coil for receiving a feedstock, the heater coil comprising an inlet manifold having a longitudinal extension; an outlet manifold having a longitudinal extension that is parallel to the longitudinal extension of the inlet manifold; and a plurality of process tubes suspended from and in fluid communication with the inlet manifold and the outlet manifold, each of the process tubes comprising an inlet leg coupled to the inlet manifold, an outlet leg coupled to the outlet manifold, and a U-shaped portion disposed between the inlet leg and the outlet leg for passage of the feedstock therethrough; wherein the inlet manifold and the outlet manifold are elevated with respect to the plurality of process tubes; and wherein each of the plurality of process tubes is aligned such that a width of each of the plurality of process tubes extends along a direction that is not perpendicular to the longitudinal extensions of the inlet and the outlet manifolds. An embodiment of the invention is one, any or all of prior embodiments in this paragraph up through the first embodiment in this paragraph wherein each of the plurality of process tubes are aligned uniformly with respect to the inlet and outlet manifolds. An embodiment of the invention is one, any or all of prior embodiments in this paragraph up through the first embodiment in this paragraph wherein the longitudinal extension of the inlet manifold and the longitudinal extension of the outlet manifold are disposed along the same vertical plane.

A second embodiment of the invention is a heater for heating a feedstock, the heater comprising a firebox chamber having opposed first and second firing walls and opposed first and second end walls; an inlet manifold having a longitudinal extension; an outlet manifold having a longitudinal extension that is parallel to the longitudinal extension of the inlet manifold; and a plurality of process tubes disposed between the first and second firing walls, the plurality of process tubes being suspended from and in fluid communication with the inlet manifold and the outlet manifold, each of the process tubes comprising an inlet leg coupled to the inlet manifold, an outlet leg coupled to the outlet manifold, and a U-shaped portion disposed between the inlet leg and the outlet leg for passage of the feedstock therethrough; wherein the inlet manifold and the outlet manifold are elevated with respect to the plurality of process tubes; and wherein each of the plurality of process tubes are aligned such that a width of each of the plurality of process tubes extends along a direction that is not perpendicular to the longitudinal extensions of the inlet and the outlet manifolds. An embodiment of the invention is one, any or all of prior embodiments in this paragraph up through the second embodiment in this paragraph wherein each of the plurality of process tubes are aligned uniformly with respect to the inlet and outlet manifolds. An embodiment of the invention is one, any or all of prior embodiments in this paragraph up through the second embodiment in this paragraph wherein the longitudinal extension of the inlet manifold and the longitudinal extension of the outlet manifold are disposed along the same vertical plane. An embodiment of the invention is one, any or all of prior embodiments in this paragraph up through the second embodiment in this paragraph further comprising a compartment disposed above the first and second firing walls wherein the inlet manifold and the outlet manifold are disposed within the compartment. An embodiment of the invention is one, any or all of prior embodiments in this paragraph up through the second embodiment in this paragraph further comprising a plurality of burners disposed along each of the first and second firing walls. An embodiment of the invention is one, any or all of prior embodiments in this paragraph up through the second embodiment in this paragraph wherein the plurality of burners are uniformly disposed along the first and second firing walls. An embodiment of the invention is one, any or all of prior embodiments in this paragraph up through the second embodiment in this paragraph wherein the plurality of burners comprise wall fired burners. An embodiment of the invention is one, any or all of prior embodiments in this paragraph up through the second embodiment in this paragraph wherein the plurality of burners comprise floor-fired burners.

A third embodiment of the invention is a heater for heating a feedstock, the heater comprising a firebox chamber having opposed first and second firing walls and opposed first and second end walls; an inlet manifold having a longitudinal extension; an outlet manifold coplanar with the inlet manifold and having a longitudinal extension that is parallel to the longitudinal extension of the inlet manifold; a plurality of process tubes uniformly disposed between the first and second firing walls, the plurality of process tubes being suspended from and in fluid communication with the inlet manifold and the outlet manifold, each of the process tubes comprising an inlet leg coupled to the inlet manifold, an outlet leg coupled to the outlet manifold, and a U-shaped portion disposed between the inlet leg and the outlet leg for passage of the feedstock therethrough; and a plurality of burners disposed along the first and second firing walls; wherein the inlet manifold and the outlet manifold are elevated with respect to the plurality of process tubes; and wherein each of the plurality of process tubes are uniformly aligned. An embodiment of the invention is one, any or all of prior embodiments in this paragraph up through the third embodiment in this paragraph wherein the plurality of burners comprise wall fired burners or floor fired burners. An embodiment of the invention is one, any or all of prior embodiments in this paragraph up through the third embodiment in this paragraph wherein the heater comprises a process heater or a furnace. An embodiment of the invention is one, any or all of prior embodiments in this paragraph up through the third embodiment in this paragraph wherein the feedstock comprises a hydrocarbon feedstock.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A heater coil for receiving a feedstock, the heater coil comprising:

an inlet manifold having a longitudinal extension;

an outlet manifold having a longitudinal extension that is parallel to the longitudinal extension of said inlet manifold; and a plurality of process tubes suspended from and in fluid communication with said inlet manifold and said outlet manifold, each of said process tubes comprising an inlet leg coupled to said inlet manifold, an outlet leg coupled to said outlet manifold, and a U-shaped portion disposed between said inlet leg and said outlet leg for passage of the feedstock therethrough;

wherein said inlet manifold and said outlet manifold are elevated with respect to said plurality of process tubes; and wherein each of the plurality of process tubes is aligned such that a width of each of the plurality of process tubes extends along a direction that is not perpendicular to the longitudinal extensions of said inlet and said outlet manifolds;

wherein the longitudinal extension of said inlet manifold and the longitudinal extension of said outlet manifold are disposed along the same vertical plane.

2. The heater coil of claim 1 wherein each of said plurality of process tubes are aligned uniformly with respect to said inlet and outlet manifolds.

3. The heater coil of claim 1 wherein the width of each of the plurality of process tubes extends between said inlet leg and said outlet leg at an angle between 60 and 85 degrees with respect to the longitudinal extensions of said inlet and said outlet manifolds.

4. The heater coil of claim 1 wherein said inlet and said outlet manifolds are separated from one another by a nonzero distance that is less than 20% of the width of each of the plurality of process tubes.

5. A heater for heating a feedstock, the heater comprising:

a firebox chamber having opposed first and second firing walls and opposed first and second end walls;

an inlet manifold having a longitudinal extension;

an outlet manifold having a longitudinal extension that is parallel to the longitudinal extension of said inlet manifold; and a plurality of process tubes disposed between said first and second firing walls, said plurality of process tubes being suspended from and in fluid communication with said inlet manifold and said outlet manifold, each of said process tubes comprising an inlet leg coupled to said inlet manifold, an outlet leg coupled to said outlet manifold, and a U-shaped portion disposed between said inlet leg and said outlet leg for passage of the feedstock therethrough;

wherein said inlet manifold and said outlet manifold are elevated with respect to said plurality of process tubes; and wherein each of the plurality of process tubes are aligned such that a width of each of the plurality of process tubes extends along a direction that is not perpendicular to the longitudinal extensions of said inlet and said outlet manifolds;

wherein the longitudinal extension of said inlet manifold and the longitudinal extension of said outlet manifold are disposed along the same vertical plane.

6. The heater of claim 5 wherein each of said plurality of process tubes are aligned uniformly with respect to said inlet and outlet manifolds.

7. The heater of claim 5 further comprising a compartment disposed above said first and second firing walls wherein said inlet manifold and said outlet manifold are disposed within the compartment.

8. The heater of claim 5 further comprising a plurality of burners disposed along each of said first and second firing walls.

9. The heater of claim 8 wherein said plurality of burners are uniformly disposed along said first and second firing walls.

10. The heater of claim 8 wherein said plurality of burners comprise wall fired burners.

11. The heater of claim 8 wherein said plurality of burners comprise floor-fired burners.

12. The heater of claim 5 wherein the width of each of the plurality of process tubes has a width extending between said inlet leg and said outlet leg at an angle between 60 and 85 degrees with respect to the longitudinal extensions of said inlet and said outlet manifolds.

13. The heater of claim 5 wherein said inlet and said outlet manifolds are separated from one another by a nonzero distance that is less than 20% of a width of each of the plurality of process tubes extending between said inlet leg and said outlet leg.

14. A heater for heating a feedstock, the heater comprising:

a firebox chamber having opposed first and second firing walls and opposed first and second end walls;

an inlet manifold having a longitudinal extension;

an outlet manifold coplanar with said inlet manifold and having a longitudinal extension that is parallel to the longitudinal extension of said inlet manifold;

a plurality of process tubes uniformly disposed between said first and second firing walls, said plurality of process tubes being suspended from and in fluid communication with said inlet manifold and said outlet manifold, each of said process tubes comprising an inlet leg coupled to said inlet manifold, an outlet leg coupled to said outlet manifold, and a U-shaped portion disposed between said inlet leg and said outlet leg for passage of the feedstock therethrough; and a plurality of burners disposed along said first and second firing walls;

wherein said inlet manifold and said outlet manifold are elevated with respect to said plurality of process tubes; and wherein each of the plurality of process tubes are uniformly aligned such that each of the plurality of process tubes has a width extending between said inlet leg and said outlet leg at an angle that is between 60 and 85 degrees with respect to the longitudinal extensions of said inlet manifold and said outlet manifold.

15. The heater of claim 14 wherein said plurality of burners comprise wall fired burners or floor fired burners.

16. The heater of claim 14 wherein the heater comprises a process heater or a furnace.

17. The heater of claim 14 wherein the feedstock comprises a hydrocarbon feedstock.

18. The heater of claim 14 wherein said inlet and said outlet manifolds are separated from one another by a nonzero distance that is less than 20% of a width each of the plurality of process tubes extending between said inlet leg and said outlet leg.

* * * * *